US006876820B2

(12) United States Patent
Hirai et al.

(10) Patent No.: US 6,876,820 B2
(45) Date of Patent: Apr. 5, 2005

(54) IMAGE FORMING APPARATUS

(75) Inventors: Masashi Hirai, Katano (JP); Kohichi Yamauchi, Yamatokoriyama (JP); Fumio Shimazu, Nara (JP); Hiroshi Tachiki, Yamatokoriyama (JP); Yuji Nakagawa, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/777,882

(22) Filed: Feb. 11, 2004

(65) Prior Publication Data

US 2004/0161252 A1 Aug. 19, 2004

(30) Foreign Application Priority Data

Feb. 18, 2003 (JP) ..... P2003-039839

(51) Int. Cl.[7] ..... G03G 15/00; G03G 15/08; G03G 15/16

(52) U.S. Cl. ..... 399/21; 399/18; 399/19; 399/20

(58) Field of Search ..... 399/18–22, 121, 399/122, 11, 124, 388

(56) References Cited

U.S. PATENT DOCUMENTS 5,502,545 A * 3/1996 Tsuruoka ..... 399/21
5,532,793 A * 7/1996 Kogure ..... 399/19
5,761,567 A * 6/1998 Yoshizuka ..... 399/17
5,893,657 A * 4/1999 Matsuzawa ..... 399/18
5,970,274 A * 10/1999 Rath ..... 399/21
6,011,936 A * 1/2000 Kaneko ..... 399/21
6,775,486 B2 * 8/2004 Matsuyama et al. ..... 399/21
2003/0099476 A1 * 5/2003 Minakuchi et al. ..... 399/21

FOREIGN PATENT DOCUMENTS

| | | |
|---|---|---|
| JP | 62-264144 | 11/1987 |
| JP | 05-053405 | 3/1993 |
| JP | 07-281534 | 10/1995 |
| JP | 11-119490 | 4/1999 |

* cited by examiner

*Primary Examiner*—Andrew H. Hirshfeld
*Assistant Examiner*—Marissa Ferguson
(74) *Attorney, Agent, or Firm*—Edwards & Angell, LLP; David G. Conlin; George W. Hartnell, III

(57) ABSTRACT

A plurality of photosensitive drums are disposed in a sheet transport direction so as to be in contact with a transfer belt and a transfer voltage for transferring toner images on the photosensitive drums onto a sheet transported by the transfer belt is applied thereto. A sensor for sensing a temperature or humidity in the working atmosphere of the image forming apparatus is provided; when a jam occurs, sheet transportation is ceased at a first stage to thereby enable the sheet in the jam to be removed; at a second stage subsequent thereto, transportation of the sheet is restarted; and a transport distance of the sheet is controlled based on a printing ratio of an image formed on the sheet.

16 Claims, 12 Drawing Sheets

IMAGE FORMING APPARATUS

CROSS REFERENCE

This Nonprovisional application claims priority under 35 U.S.C. § 119(a) on Patent Application No. 2003-039839 filed in Japan on Feb. 18, 2003, the entire contents of which are hereby incorporated by reference.

BACKGROUND OF THE INVENTION

The present invention relates to an image forming apparatus such as a copy machine, a printer, a facsimile and the like, in which various kinds of images are formed on a sheet recording medium, and particularly, to a jam processing technique when an anomaly in transportation (a jam) of a sheet recording medium occurs.

There has been available image forming apparatuses each forming an image in a procedure in which a toner image formed on an image carrier is transferred onto a sheet recording medium on a transfer carrier by electrostatic attraction and thereafter, the toner image is fixed on the sheet recording medium in a fixing device. Of such image forming apparatuses, especially in a tandem type image forming apparatus in which plural image forming stations each including an image carrier and an image forming process means placed therearound are disposed along a direction in which a sheet recording medium is transported, a single transfer carrier is formed opposite the image forming stations and therefore, the transfer carrier is eventually long.

Therefore, in a case where a jam occurs during transportation of sheet recording media being continuously fed, which leads to an emergency shutdown of an image forming apparatus, a sheet recording medium stops between an image carrier and a transfer carrier in more of cases. Especially in a case where a jam occurs in a fixing section, the operation has to be urgently shutdown. In such a case, a possibility is high that a subsequent sheet recording medium stays stopping between an image carrier and the transfer carrier.

In such a case where a sheet recording medium stays unmoving between an image carrier and the transfer carrier, it is difficult to take out the sheet recording medium, left unmoved, by pinching it between fingers since it is firmly attracted to the transfer carrier by static electricity and since the image carrier and the transfer carrier are in contact with each other. Therefore, for example, proposals have been made on a paper transport device or a non-peelable paper processing device in which if a jam occurs, a jam processing is performed in a way such that the transfer carrier is moved in a direction opposite a moving direction in copying operation to thereby return the sheet recording medium to a position where the sheet recording medium can be taken out with ease (see, for example, JP-A Nos. S62-264144 and H07-281534).

A proposal has been made on an image forming apparatus in which in a case where a jam of a sheet recording medium occurs, only a fixing section is caused to be out of operation and the other sections are continued to operate for a predetermined time, to transport the sheet recording medium to before the fixing section and to thereby facilitate a jam processing (see, for example, JP-A No. H05-053405 paragraph [0013] and [0016]).

A proposal has been made on a image forming apparatus in which in a case where a jam occurs and a sheet recording medium is transported to before a fixing section, a transfer voltage (a transfer bias) applied to the sheet recording medium with a transfer carrier is disconnected to alleviate an attraction force between the sheet recording medium and the transfer carrier by some amount and to thereby facilitate a jam processing (see, for example, JP-A No. H11-119490 paragraph [0055] and [0066]).

However, it is difficult to visually find a sheet recording medium present between a transfer carrier and an image carrier and it is common not to install a means for detecting a sheet recording medium present on the transfer carrier in most of image forming apparatuses currently available. Hence, when a jam occurs, it is difficult for an image forming apparatus itself or for a user to determine whether or not a sheet recording medium is in a state being left firmly attracted to the transfer carrier.

Therefore, if a transfer carrier is always moved back when a jam occurs despite a high possibility of the absence of a sheet recording medium on the transfer carrier as described in JP-A Nos. S62-264144 and H07-281534, a wasteful time is forcibly consumed in some case, leading to an issue of being uneconomical. In a case where a detector detecting a sheet recording medium present on a transfer carrier is installed, problems arise that an image forming section is large in size and that increase occurs in manufacturing cost or assembling cost.

In a case of JP-A No. H05-053405, if a jam of a sheet recording medium occurs, only a fixing section is caused to be out of operation and the other sections are continued to operate for a predetermined time, to transport the sheet recording medium to before the fixing section and to thereby facilitate a jam processing. In JP-A No. H11-119490, it is disclosed that in a case where a jam occurs, application of a transfer voltage (a transfer bias) to the sheet recording medium through a transfer carrier is ceased when a sheet recording medium is transported to before a fixing section to thereby alleviate an attraction force between the sheet recording medium and the transfer carrier by some amount and to thereby facilitate a jam processing.

In a case where a jam occurs, if the transfer bias is disconnected, a problem arises that an attraction force of a sheet recording medium to a transfer carrier is reduced to thereby disable the sheet recording medium to be transported to the fixing section. Furthermore, if a sheet recording medium is excessively transported toward the fixing section in a state where transportation of the sheet recording medium in the fixing section is ceased, a problem arises that the interior of the image forming apparatus is made dirty with unfixed toner having been transferred onto the sheet recording medium, causing a problem that a hand and the lower part of a sleeve is made dirty in jam processing.

SUMMARY OF THE INVENTION

It is an object of the present invention to provide an image forming apparatus capable of easily performing a jam processing operation without provoking a failure in transportation of a sheet recording medium.

It is another object of the present invention to provide an image forming apparatus capable of easily performing a jam processing operation without making the interior of the apparatus dirty with toner.

The present invention, in order to solve the problems, is directed to an image forming apparatus including:

plural image carriers that carry toner images formed by an image forming process in operation thereof and are disposed along a sheet transport direction;

a transfer carrier for transporting a sheet recording medium attracting it in the sheet transport direction and transferring the toner images carried on the plural image carriers to the sheet recording medium;

a transfer voltage applying section for applying a transfer voltage to the sheet recording medium carried on the transfer carrier;

a fixing device for fixing a toner image on the sheet recording medium transported by the transfer carrier and is installed so as to be capable of moving toward outside of a side surface of the body of the image forming apparatus; and a jam processing control section for detecting occurrence of a jam on the sheet recording medium during the image forming process to process the sheet recording medium in the jam, wherein the jam processing control section, when detecting occurrence of the jam, ceases transportation of the sheet recording medium in the jam by the transfer carrier as a first stage to make it possible to remove the sheet recording medium in the jam, and, if a second sheet recording medium in transit when the jam occurs is detected by the transfer carrier, advances to a second stage and restarts transportation of the second sheet recording medium in transit using the transfer carrier so that a transport distance thereof corresponds to a printing ratio of the image formed on the second sheet recording medium.

In an image forming apparatus such as a copy machine, a printer, a facsimile or the like, a sheet recording medium is transported between an image carrier and a transfer carrier being firmly attracted on the transfer carrier. An attraction force here increases in proportion to an area of a sheet recording medium in which to be firmly attracted to the transfer carrier. If an attraction force is stronger, difficulty is encountered in taking out a sheet recording medium staying stagnant inside the apparatus when a jam occurs.

Therefore, with a smaller attraction force, it is easier to take out a sheet recording medium stagnant within the apparatus. An attraction force between a sheet recording medium and the transfer carrier is greatly affected by a printing ratio of the image formed on the sheet recording medium.

Therefore, at the first stage immediately after occurrence of a jam is detected, it is enabled to remove a sheet recording medium in the jam and furthermore, at the second stage subsequent thereto, the jam processing control section restarts transportation of the sheet recording medium and controls a transport distance of the sheet recording medium according to a printing ratio of the image formed on the sheet recording medium. By doing so, the sheet recording medium on a transport path (on the transfer carrier) which cannot be removed at the first stage can be surely transported with a proper attraction force to be eventually removed.

Since a developing agent (a toner) remains on the image carriers when a jam occurs and the apparatus is rendered out of operation, there arises a chance of a great bend of the sheet recording medium on the transport path due to a lengthy distance thereof if the sheet recording medium is tried to be transported at the second stage as described above. In such a case, an unfixed toner on the bent portion makes dirty members in the peripheral region of the transport path with a high possibility.

Therefore, at the first stage immediately after occurrence of the jam is detected, it is made possible to remove a sheet recording medium in the jam and at the second stage subsequent thereto, the jam processing control section restarts transportation of the sheet recording medium and controls a transport length of the sheet recording medium in transit according to a printing ratio of the image formed on the sheet recording medium.

To be concrete, for example, the jam processing control section controls such that a transport distance of the sheet recording medium at the second stage is larger at a lower printing ratio than at higher printing ratio.

The jam processing control section, when detecting occurrence of the jam, transports at the first stage the sheet recording medium by a transport distance corresponding to a printing ratio of the image formed on the sheet recording medium and stops it there, thereby enabling removal of the sheet recording medium in the jam.

DETAILED DESCRIPTION OF THE INVENTION

Detailed description will be given of an image forming apparatus related to an embodiment of the present invention below with reference to the accompanying drawings.

Figure 1:
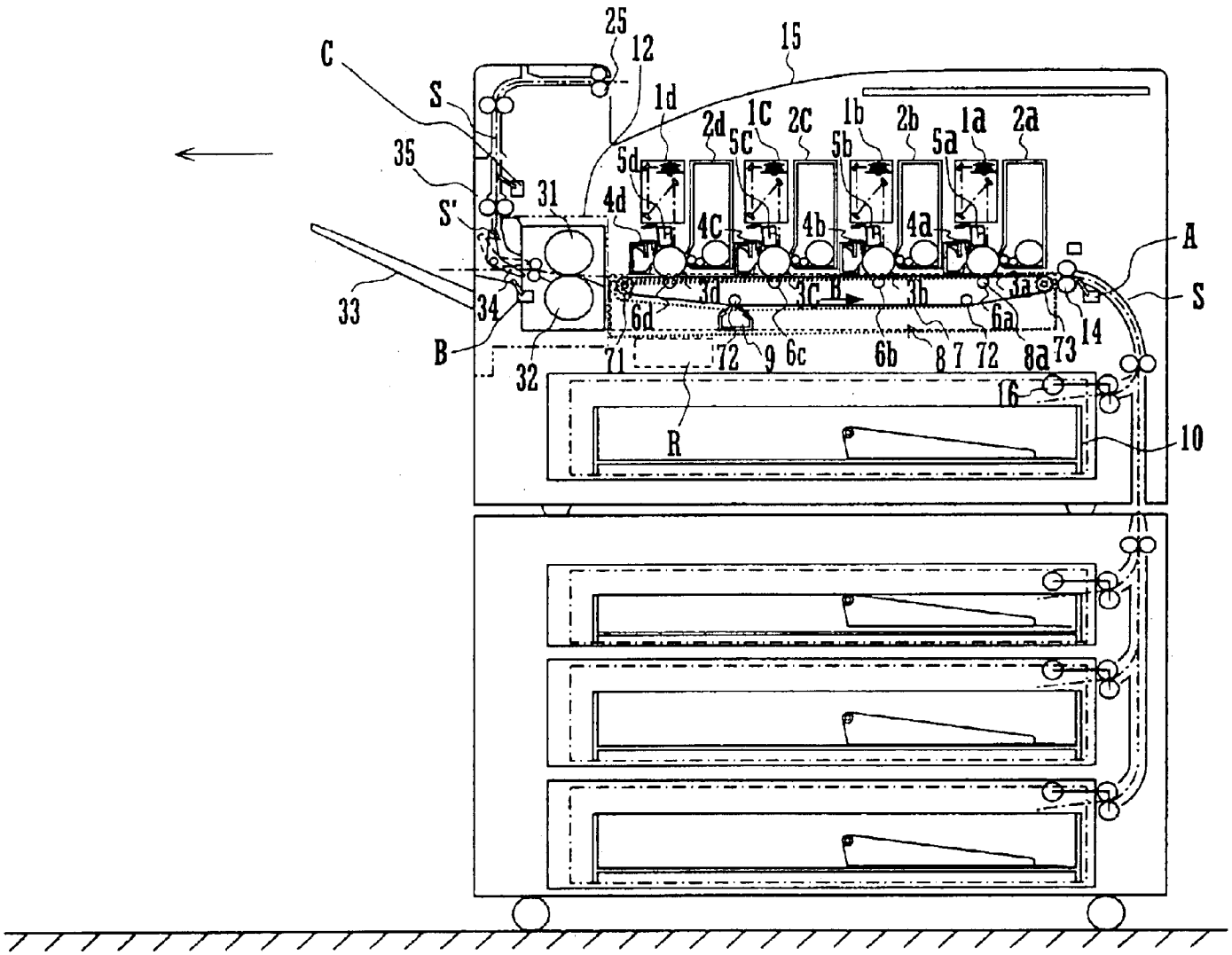
FIG. 1 is a configuration of a main section of an image forming apparatus related to an embodiment of the present invention.

FIG. 1 shows a configuration of an image forming apparatus.

The image forming apparatus forms an image in multiple colors or a single color on a predetermined sheet recording medium (hereinafter referred to as sheet) according to image data transmitted from outside and includes: exposure units 1; developers 2; photosensitive drums (image carriers) 3; chargers 5; cleaner units 4; a transfer transport belt unit 8; a fixing unit 12; a paper transport path S; paper feed trays 10; a paper discharge tray 15; and the like.

Image data handled in the image forming apparatus corresponds to a color image using colors of black (K), cyan (C),magenta (M) and yellow (Y). Four image stations Pa (black), Pb (cyan), Pc (magenta) and Pd (yellow) are constituted of the exposure units 1 (1*a*, 1*b*, 1*c* and 1*d*), the developers 2 (2*a*, 2*b*, 2*c* and 2*d*), the photosensitive drum 3 (3*a*, 3*b*, 3*c* and 3*d*), the chargers 5 (5*a*, 5*b*, 5*c* and 5*d*), and the cleaner units 4 (4*a*, 4*b*, 4*c* and 4*d*), respectively, and latent images corresponding to colors are formed in the respective image stations.

The photosensitive drums 3 are set in almost the center of the image forming apparatus.

The chargers 5 each are charging means for charging a surface of a corresponding photosensitive drum 3 uniformly at a predetermined potential. Employed as the charging means each are a charger as shown in the figure in addition to a contact type roller charger or a contact type brush charger.

Of the photosensitive drums 3, the photosensitive drum 3*a* is disposed in the most upstream side in the direction of sheet transportation.

The exposure units 1 each are a laser scanning unit (LSU) equipped with, for example, a LED write head having a light emitting elements arranged in an array, a laser illuminating section and a reflective mirror depicted in the figure. A photosensitive drum 3 charged with a charger 5 is exposed according to image data by an exposure unit 1 and an electrostatic latent image corresponding to the image data is formed on the surface thereof.

A developer 2 visualizes an electrostatic latent image formed on a photosensitive drum 3 with a toner (in one of colors K, C, M and Y). A cleaner unit 4 removes and recovers the toner remaining on the surface of a photosensitive drum after development and image transfer.

The transfer transport unit 8 placed below the photosensitive drums 3 includes: a transfer belt 7, a transfer belt driving roller 71, a transfer belt tension roller 73, plural transfer belt-driven rollers 72 and 73, transfer rollers 6 (6*a*, 6*b*, 6*c* and 6*d*) and a transfer belt cleaning unit 9. The transfer belt 7 spans with tension over the transfer belt driving roller 71, the transfer belt-driven rollers 72 and 74 and the transfer belt tension roller 73 and is rotation driven in a direction of an arrow mark B.

The transfer rollers 6 are rotatably supported on respective shafts in a housing inside the transfer transport unit 8 and spans the transfer belt 7 with tension across the transfer belt driving roller 71 and the transfer belt tension roller 73 under cooperation of the transfer belt-driven rollers 72 and 74. The transfer rollers 6 transfers toner images on the photosensitive drums 3 onto a sheet firmly attracted on the transfer belt 7.

The transfer belt 7 is fabricated using a film of a thickness of the order of 100 to 150 $\mu$m in an endless state and set in a way so as to be movable apart from or into contact with the photosensitive drums 3. The transfer belt 7, in a multicollor mode (see FIG. 9) in which image formation is performed in contact with all of the photosensitive drums 3, works such that toner images in colors formed on the respective photosensitive drums 3 are sequentially superimposed on one on another to thereby form a color toner image (multicolor image).

On the other hand, in a single color mode in which the transfer belt 7 is brought into contact with only the photosensitive drum 3*a* while the other photosensitive drums 3*b*, 3*c* and 3*d* are spaced apart from the transfer belt 7 (see FIG. 10), the transfer belt works such that a toner image in black (monochromatic toner image) is transferred onto a sheet to form a black-and-white image.

Figure 9:
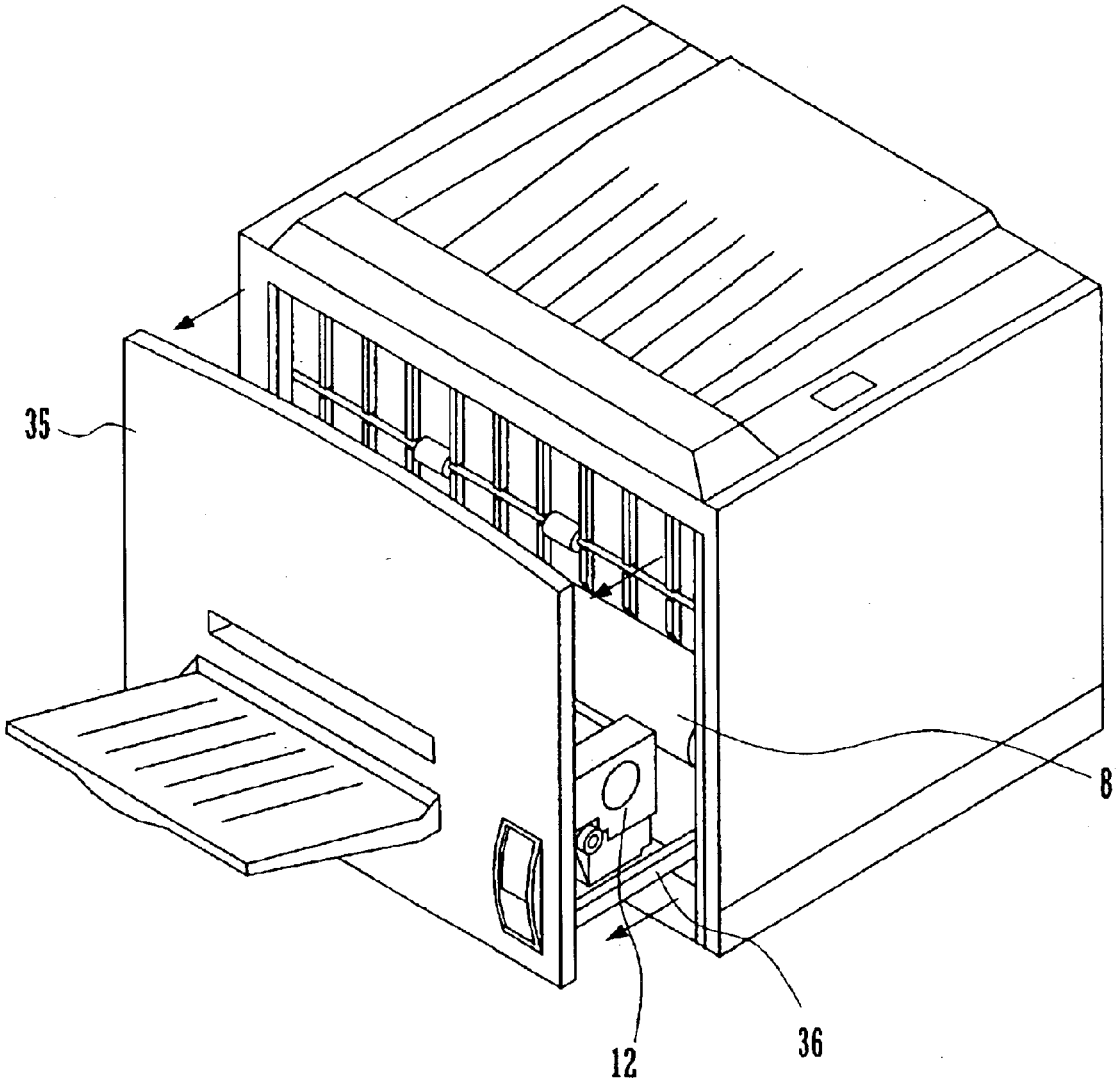
FIG. 9 is a descriptive view in a state where a fixing unit is drawn out.
Figure 10:
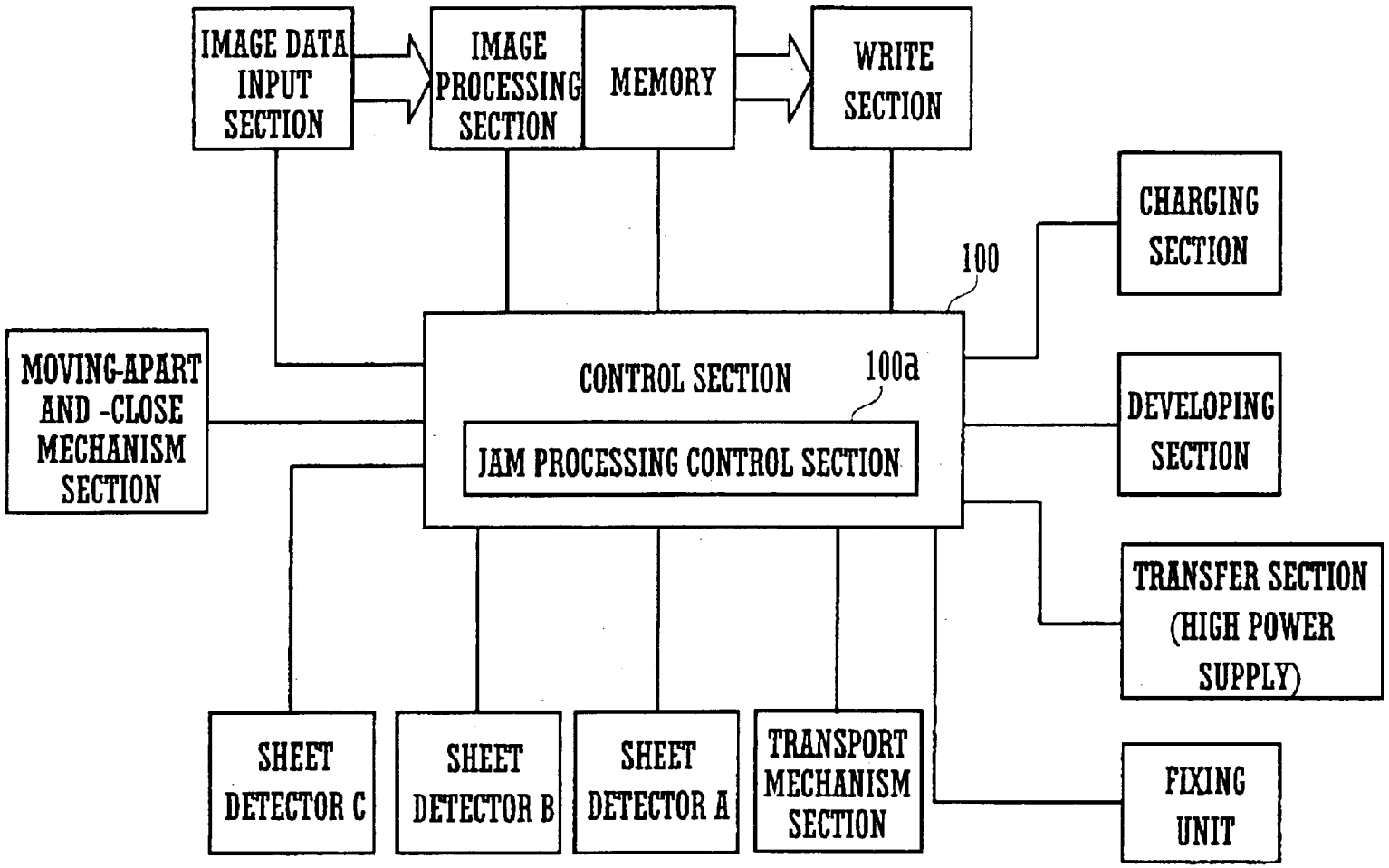
FIG. 10 is a control system block diagram of jam processing control means.

A change-over operation of the transfer belt 7 between both modes is realized by a change-over means 38 as shown in FIGS. 9 and 10. That is, the change-over means 38 includes a cam 43 rotated by a driving source such as a stepping motor not shown. The cam 43 is rotation driven in sliding contact with a support piece 50 of the transfer transport unit 8. By doing so, the transfer transport unit 8 is pivoted upwardly or downwardly around a shaft of the transfer roller 6*a* in the upstream side.

Transfer of toner images from the photosensitive drums 3 to a sheet are performed by the transfer rollers (6*a*, 6*b*, 6*c* or 6*d*) in contact with the rear side of the transfer belt 7. A high voltage (a high voltage of a polarity (+) opposite a charge polarity (−) of a toner) is applied to the transfer rollers 6 in order to transfer toner images by high voltage power supplies (60*a* to 60*d*) in a transfer section, or an AC high voltage is applied to the transfer rollers 6 in order to remove a charge on the transfer belt 7 depending on a situation when a sheet transport jam occurs.

A transfer roller 6 is a roller of a structure having a shaft made of a metal (for example, stainless) and of a diameter in the range of from 8 to 10 mm as a base and the surface thereof is covered with a conductive elastic material (for example, EPDM, foamed urethane or the like). A high voltage can be applied uniformly on a sheet with the help of the conductive elastic material.

A toner attached to the transfer belt 7 from a photosensitive drum 3 renders the rear surface of a sheet dirty; therefore, the toner is removed and recovered by the transfer belt cleaning unit 9.

The paper feed tray 10 is a tray storing sheets used in printing and set in the lower side of an image forming section of the image forming apparatus. The paper discharge tray 15 provided in the top portion of the image forming apparatus is a tray in which printed sheets are stacked face down. The paper discharge tray 33 provided in a side portion of the image forming apparatus is a tray in which printed sheets are stacked face up.

Provided in the image forming apparatus is the paper transport path S in the shape of a letter S to transport a sheet in the paper feed tray 10 to the paper discharge tray 15 via the transfer transport unit 8 and the fixing unit 12. Pick-up rollers 16, a resist roller 14, the fixing unit (fixing section) 12, a transport direction change-over gate 34, transport rollers 25 and the like are set in the neighborhood of the paper transport path S to as far as the paper discharge trays 15 and 33 from the paper feed trays 10.

The plural transport rollers 25 are small rollers for promoting and assisting transportation of a sheet and placed along the paper transport path S. A pick-up roller 16 is an intake roller located at an end of a paper feed tray 10 to feed a sheet from the paper feed tray 10 one sheet at a time into the paper transport path S.

The transport direction change-over gate 34 is provided rotatably on the side cover 35 and is changed over from a position shown with a solid line to a position shown by a broken line to thereby separate a sheet in transit on the paper transport path S therefrom and to discharge the sheet to the paper discharge tray 33.

On the other hand, in a case where the transport direction change-over gate 34 is in a position shown with the solid line, a sheet is discharged to the paper discharge tray 15 in the top portion through a transport path S' (part of the paper transport path S) formed between the fixing unit 12 and the side cover 35 and the transport change-over gate 34.

The resist roller 14 placed in the most upstream side of the transfer belt 7 works so as to temporarily hold a sheet transported on the paper transport path S. Furthermore, the resist roller 14 has a function to transport the sheet in good timing so as to be matched with rotation of the photosensitive drums 3 so that toner images on the photosensitive drums 3 are sequentially multiple-transferred on the sheet in good alignment.

That is, the resist roller 14 sets a sheet in transport timing so that the leading edge of a toner image on each photosensitive drum 3 coincides with the leading edge of a printing range on the sheet based on a detection signal outputted by a sheet detector A. The sheet detector A monitors a transport timing of the sheet. Jam detection or the like is effected with a signal from the sheet detector A as a reference.

The fixing unit 12 includes: a heat roller 31; a pressure roller 32 and the like and the heat roller 31 and the pressure roller 32 are configured so as to rotate while pinching a sheet therebetween. In the heater roller 31, a state of ON or OFF of a heater lamp not shown is controlled by a control section based on an output value of a temperature detector not shown so as to keep a temperature thereof at a predetermined fixing temperature, and the heater roller 31 and the pressure roller 32 cooperatively heat-compresses the sheet and to thereby, thermally fix a single color toner image or a multicolor toner image transferred onto the sheet through a process including melting and mixing and press contact.

The sheet after the toner image is fixed thereon in the fixing unit 12 is discharged selectively onto the discharge tray 33 or 15 by the transport rollers 25. In this step, a state of the sheet in transportation after the fixing is monitored by the sheet detector B, the sheet detector C and other sheet detectors not shown.

While description here is given of a color image formation apparatus, this may apply to a configuration with a single color image forming station (a monochromatic image forming apparatus). While in this embodiment, the body of the image forming apparatus is placed on a paper feed desk device having a three layer paper feed tray stack, the present invention is not limited to this particular case and a paper feed device may be selected from various kinds of types by a user.

In this embodiment, the image forming apparatus constructed as described above is equipped with a jam processing control section for performing a jam processing with a good efficiency, easiness and certainty in a case where a jam occurs on a sheet during transportation. The control section controls a transfer bias and a transport distance of a sheet so as to be adapted for an environmental condition in a desirable embodiment.

Figure 2:
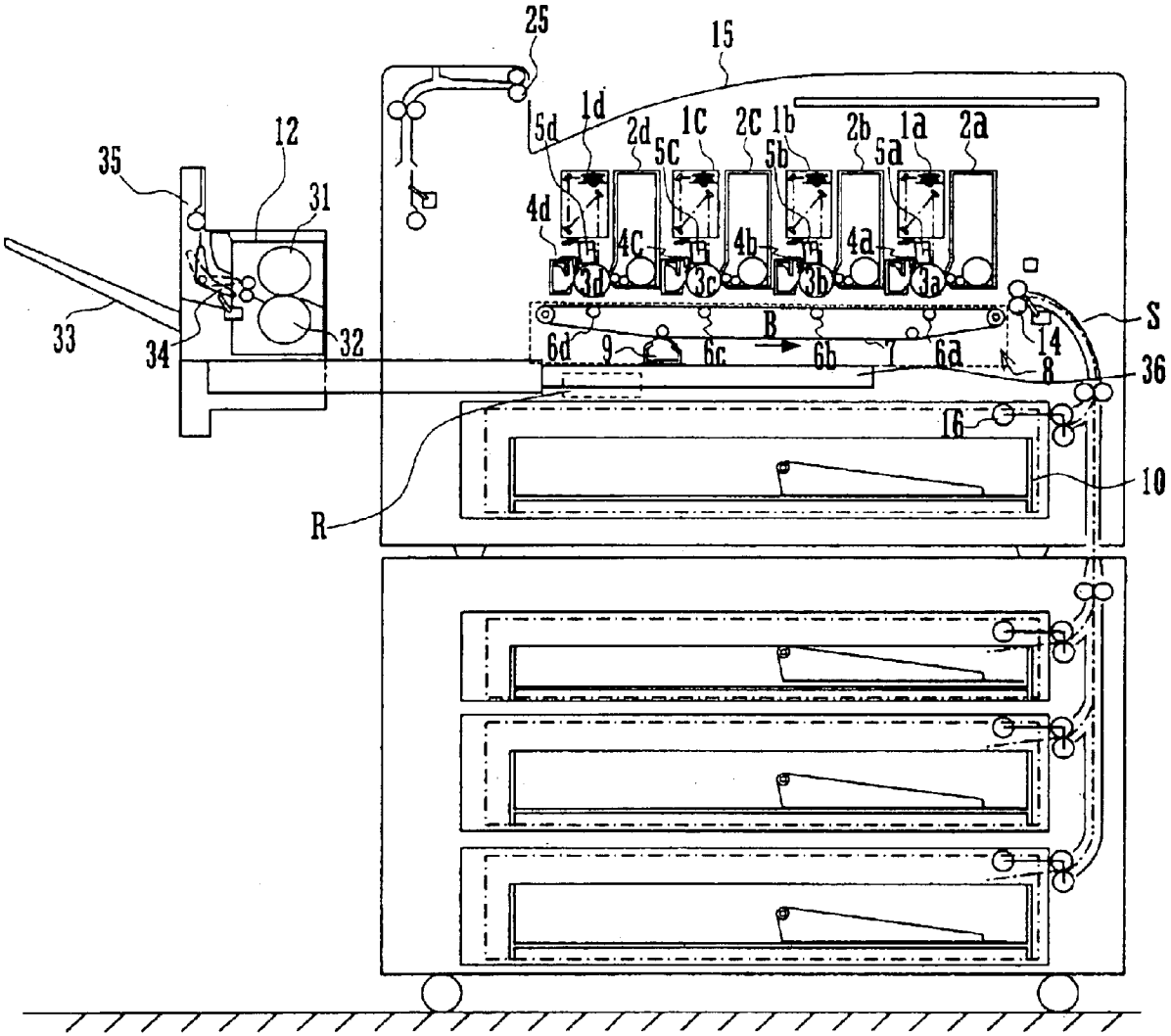
FIG. 2 is a configuration of a main section in a state where a fixing unit is drawn out.

The fixing unit 12 integrated into one piece with the side cover 35 having the paper discharge tray 33, as shown in FIG. 2, can be drawn out toward the downstream side in the transport direction of the transfer transport unit 8 (in a transport direction of a sheet) with the help of a slide member 36 laterally set across the both sides, front and rear, of the body of the image forming apparatus (see FIG. 9).

When a jam processing is performed, the fixing unit 12 is drawn out together with the side cover 35 from the body of the image forming apparatus and the transfer belt 7 is moved apart from all of the photosensitive drums 3, interlocking with the draw-out operation of the fixing unit 12. Furthermore, the transport belt 7 can be restored to the original state again interlocking with an accommodating operation of the fixing unit 12.

That is, in this embodiment, the image forming apparatus has a moving-apart or -close mechanism (moving-apart or -close means R) for moving the transfer belt 7 supported by the transfer transport unit 8 apart from or into contact with all of the photosensitive drums 3 (3*a* to 3*d*). The moving-apart or -close mechanism links with a slide operation (see FIG. 11) of the slide member 36 integrated with the fixing unit 12 into one piece. A construction is such that a cam mechanism, not shown, mounted to the slide member 36 is engaged with the transfer transport unit 8 and the change-over means 38 to thereby enable the transfer belt 7 to be moved apart from or into contact with all of the photosensitive drum 3, and the relationship between the transfer belt 7 and all of the photosensitive drum 3 can be restored to the original state interlocking with an accommodation operation of the fixing unit 12.

The slide member 36 can preferably perform a smooth movement while supporting the fixing unit 12 having a relatively heavy weight with a high accuracy, for example, by using a slide bearing such as a high accuracy accuride, whereas any of other slide means may be employed as far as a high accuracy positioning is enabled when the fixing unit 12 is returned to a predetermined position of the body of the image forming apparatus.

In this embodiment, the transfer transport unit 8 including the transfer belt 7, as described above, is supported so that the downstream side is pivotable relative to the body of the image forming apparatus around a fulcrum shaft, not shown, as a rotation center, provided in a housing section of the transfer transport unit 8, and located at a site on an extension of the shaft of the transfer roller 6*a* in the upstream side. A construction is adopted in which the change-over means 38 changes over between a state of a multicolor mode, shown in FIG. 9, in which the transfer transport belt unit 8 is brought into contact with all of the photosensitive drums 3 almost in parallel relative thereto and a state of a single color, shown in FIG. 10, in which the downstream side falls while only the photosensitive drum 3*a* being into contact with the transfer belt 7. Note that as detection means for detecting a position of a sheet during transportation, plural other sheet detectors similar to the sheet detectors A, B and C are equipped along the transport path S.

Figure 11:
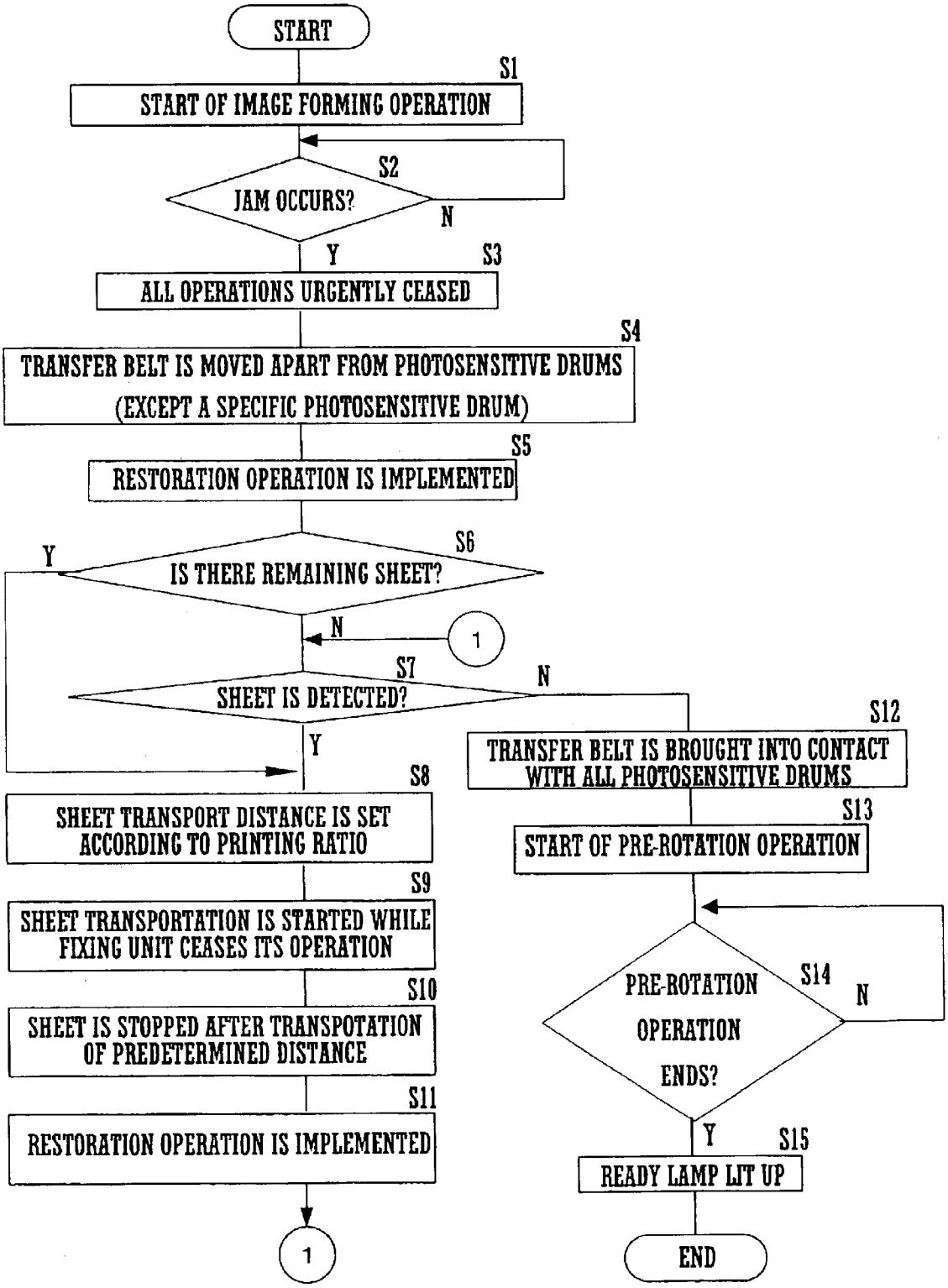
FIG. 11 is a flowchart showing an example of jam processing control.
Figure 12:
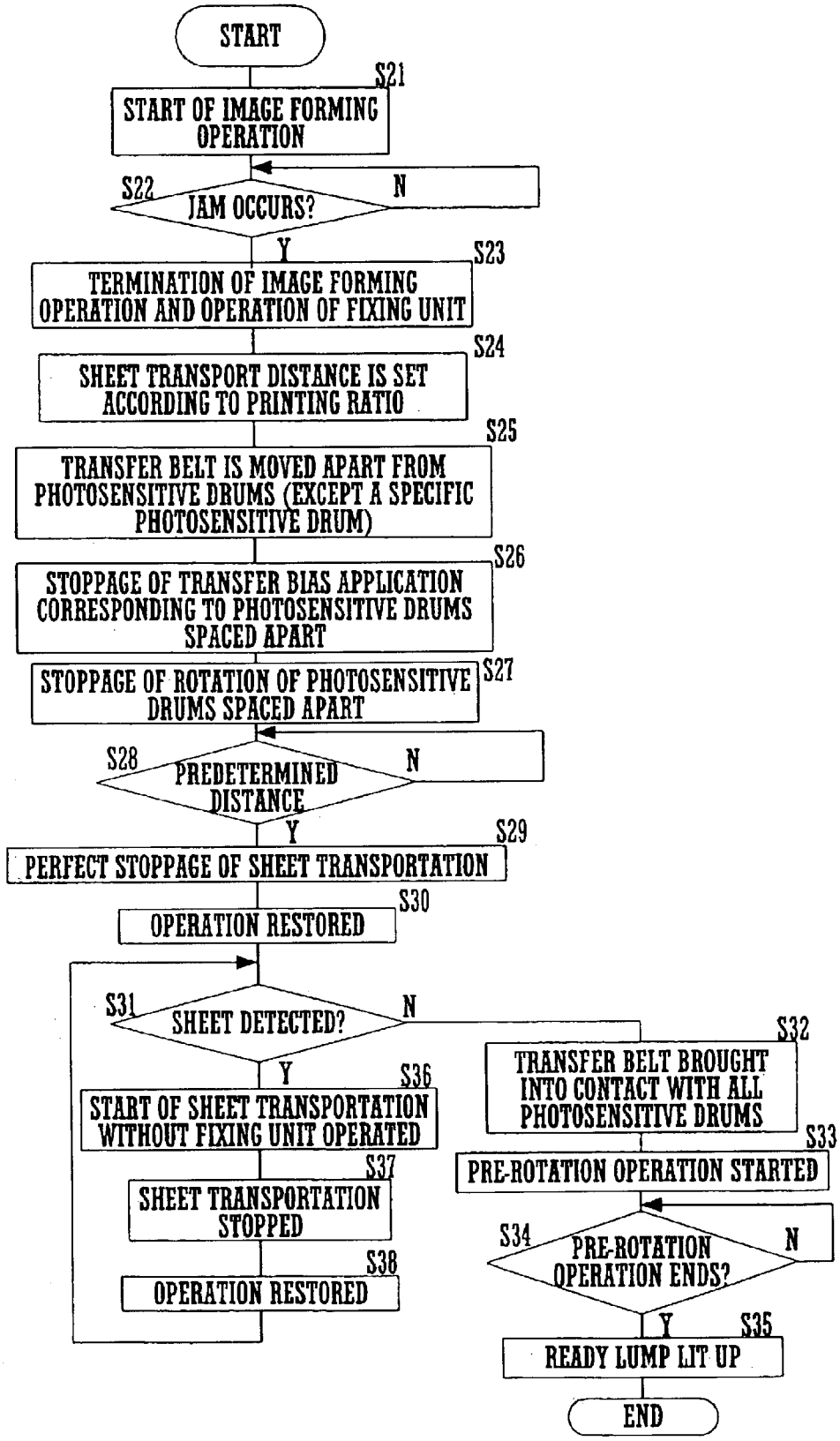
FIG. 12 is a flow chart showing another example of the jam processing control.

Description is given of control by a jam processing control section with a detection timing, as a reference, of the sheet detector A placed in the upstream side of the fixing unit 12 in flowcharts of FIGS. 11 to 12. The sheet detectors B and C placed in the downstream side of the fixing unit 12 detect states in which sheets are discharged into the discharge trays 33 and 15 and control by the jam processing control section can also be performed using the sheet detector B or C instead of the sheet detector A.

The jam processing control section 100*a*, as shown in FIG. 10 exhibiting a control system block diagram of an image forming apparatus, is incorporated in a control section including CPU, ROM and RAM and the sheet detectors A, B and C are connected to the input side thereof. Furthermore, connected to the output side are a driving source for driving the transfer belt 7, a transportation mechanism section including a crutch of the resist roller 14 as sheet transport means in the upstream side of the transfer belt 7 and others, the moving-apart or -close mechanism (including the moving-apart or -close means R and the change-over means 38) for moving the transfer belt unit 8 apart from or into contact with the photosensitive drums 3 (3*a* to 3*d*) and a high voltage power supplies 60*a* to 60*d* for supplying a transfer voltage (transfer bias) to the transfer rollers 6. Note that in the present invention, a sheet transport means in the upstream side of the transfer belt 7 is not limited to the resist roller 14 and, as described later, may includes a sheet transport roller provided along the transport path S in the upstream side of the transfer belt 7.

In this embodiment, the jam processing control section, when detecting occurrence of a jam, ceases transportation of sheets on the transfer belt 7 and enables removal of a sheet in the jam as a first stage. At the first stage, the fixing unit 12 is drawn out to remove the sheet in the jam. Then, if a sheet recording medium in transit when the jam occurs is detected, the process moves to a second stage. At the second stage, transportation of a sheet in transit is restarted by the transfer belt 7

The jam processing control section, at the second stage, again transports a sheet in transit by the transfer belt 7 and a transport distance corresponds to a printing ratio of an image formed on the sheet.

Note that while the processing method of taking out a sheet described in FIGS. 3 to 5 and 8 is conducted at the second stage, the method may be applied at the first stage.

In the transportation, it is important to properly control an attraction force by which a sheet is attracted to the transfer belt 7. That is, with a lower attraction force, a sheet staying stagnant inside the apparatus is easily taken out. An attraction force between the sheet and the transfer belt 7 is greatly affected by a printing ratio of an image formed on the sheet.

Therefore, in this embodiment, a transport distance of a sheet is controlled according to a printing ratio of an image formed on a sheet.

That is, in the control, fundamentally, when occurrence of a jam is detected, transportation of a sheet caused by the transfer belt 7 is ceased as the first stage so as to enable the sheet in the jam to be removed and then, when a sheet in transit when a jam occurs is detected, the process advances to the second stage to restart transportation of the sheet in transit with the transfer belt 7. Then, a transport distance of a sheet is controlled according to a printing ratio of an image formed on the sheet and the sheet is stopped after being transported by the transport distance. While control on a transport distance of a sheet is conducted at the second stage in this embodiment the control may also be conducted at the first stage.

FIG. 11 is a flowchart showing the control in this embodiment.

Description will be given of the flowchart below.

When a transport jam occurs after the start of image forming operation, all of the following operations associated with image forming are urgently ceased (for example, a write operation to the photosensitive drums 3 performed by the exposure units 1, rotation operations of the photosensitive drums 3, charging operations with chargers 5, developing operations performed by the developers 2, application operations of a transfer bias with transfer rollers 6, transportation of a sheet recording medium, a fixing operation in the fixing unit) (S1 to S3) and simultaneously the change-over means 38 is activated to move the transfer belt 7 apart from the photosensitive drums 3*b*, 3*c* and 3*d* except the photosensitive drum 3*a* (S4). This is to disconnect supply of charging from the photosensitive drums 3*b* to 3*d* working for firmly attracting the sheet to the transfer belt 7 as well and to thereby reduce a force required to peel off the sheet from the transfer belt 7, which follows.

Note that in a case where an inversion development is employed, charging operations of the chargers 5 are necessary operations in rotation of the photosensitive drums 3 regardless of image forming. This is because if the photosensitive drums 3 are not charged while being rotated, the developing agent is attached onto the photosensitive drums 3. Therefore, in a case where the photosensitive drums 3 rotate in company with transportation of a sheet recording medium in S 9 (and S9' of FIG. 14) to come later, a charging operation of the charger 5*a* is conducted to the photosensitive drum 3*a* in rotation.

While description is given above of a case where the transfer belt 7, in step S4, are moved apart from the photosensitive drums 3*b* to 3*d* except the photosensitive drum 3*a*, a similar effect can be obtained by turning off a transfer bias to be applied to the transfer rollers 6*b* to 6*d* or by setting a transfer bias to a proper value without moving the transfer belt 7 apart from the photosensitive drums 3.

In the above step S4, a display of occurrence of a jam is presented on an operating section and an operator conducts a jam processing (restoration operation) after the transfer belt 7 is moved apart from the photosensitive drums 3*b* to 3*d* except the photosensitive drum 3*a* (S5). The stage is the first stage.

Figure 3:
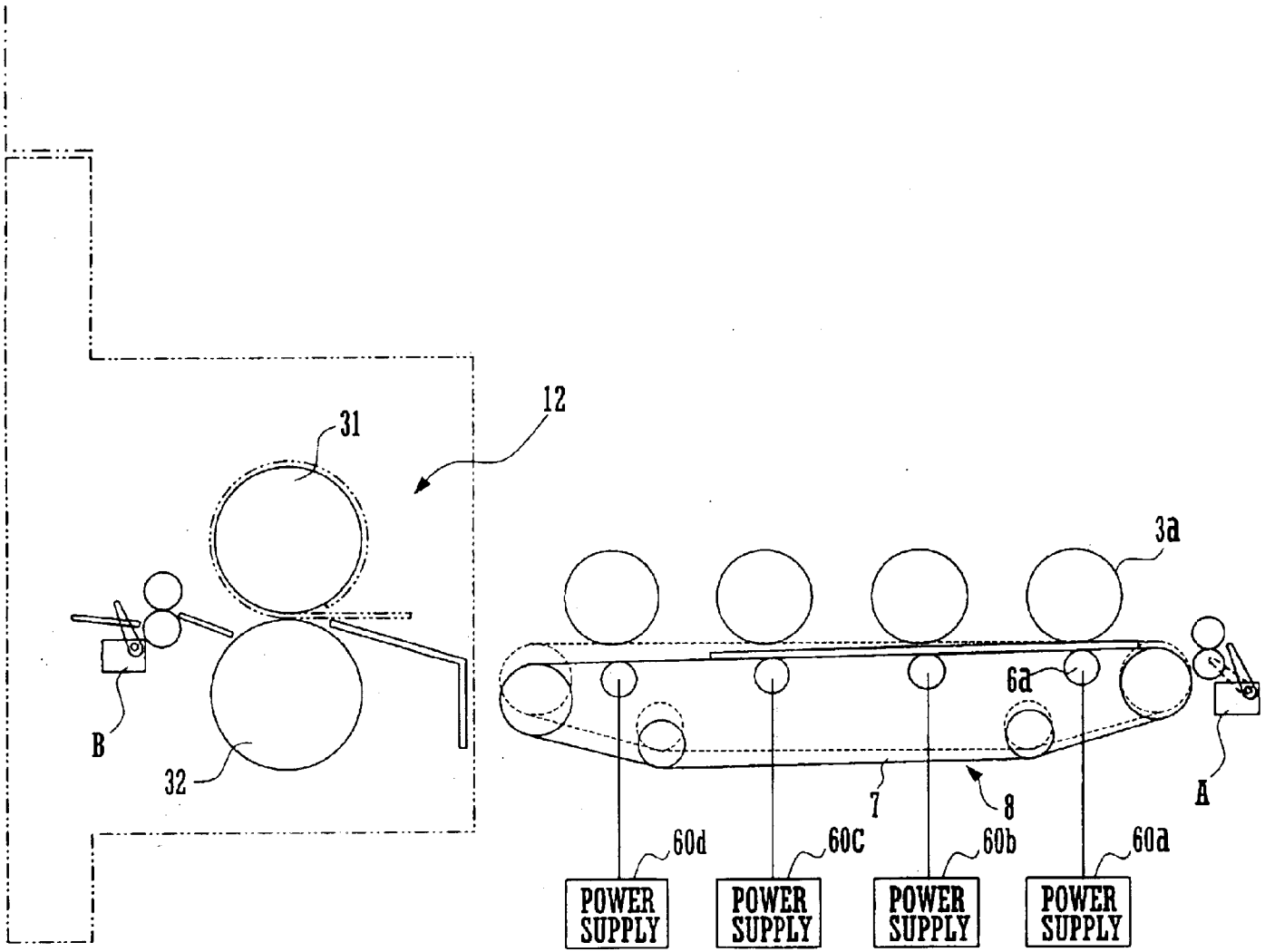
FIG. 3 is a descriptive view in a state where a transfer carrier is stopped in an emergency.
Figure 5:
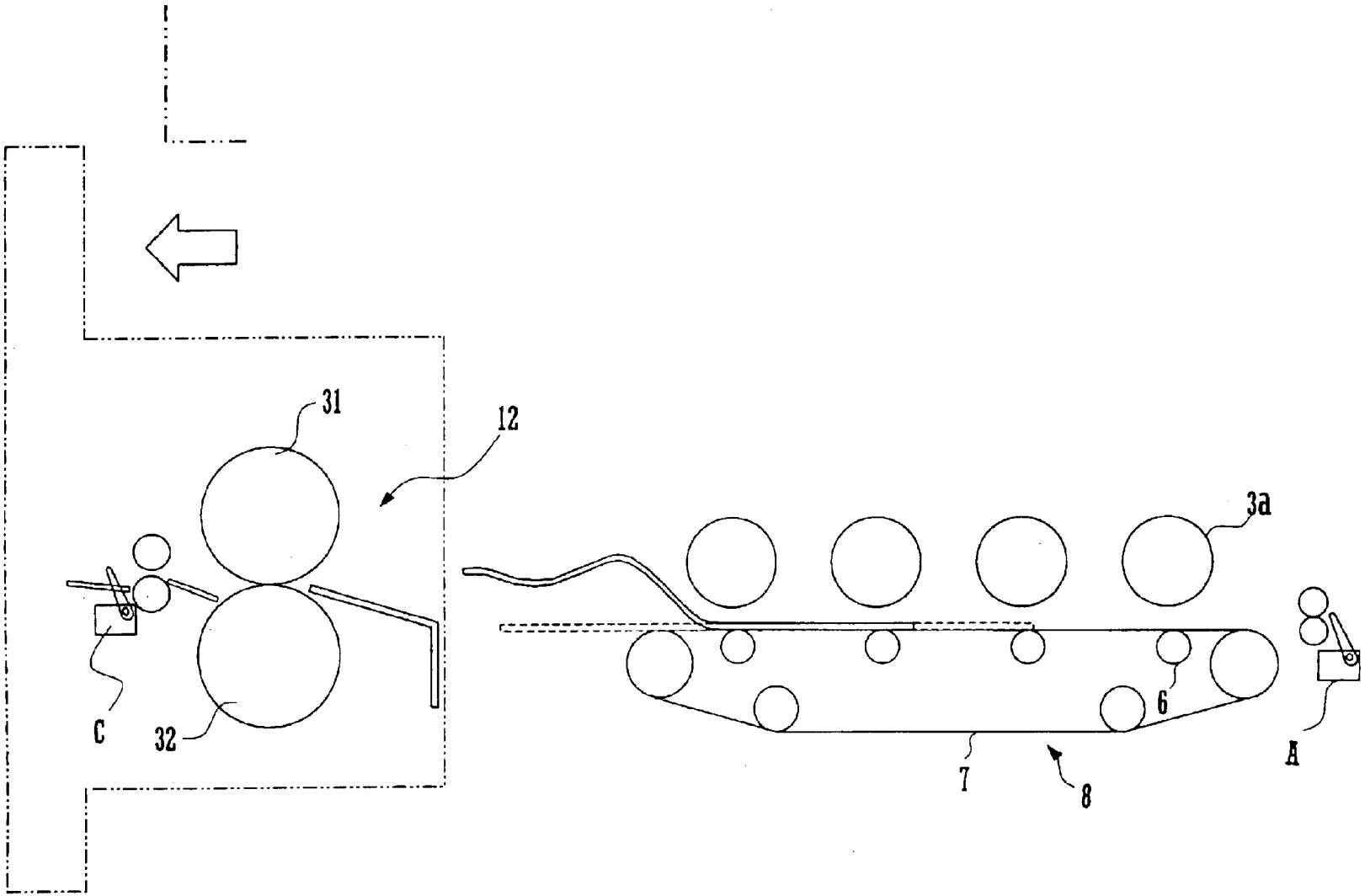
FIG. 5 is a descriptive view in a case where a fixing unit is drawn out to perform a jam processing.
Figure 6:
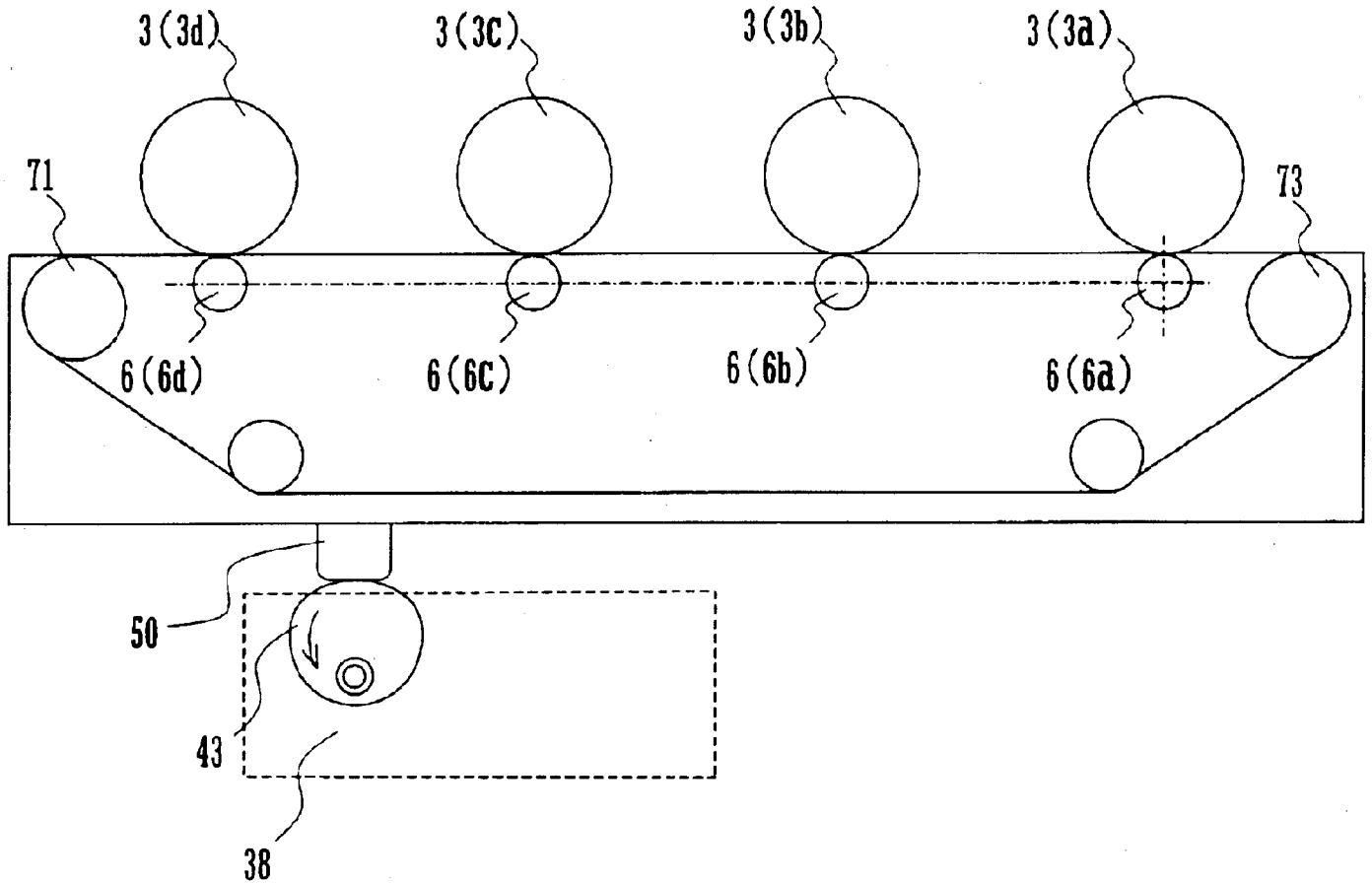
FIG. 6 is a descriptive view showing a state of a transfer carrier in a multicolor mode.
Figure 7:
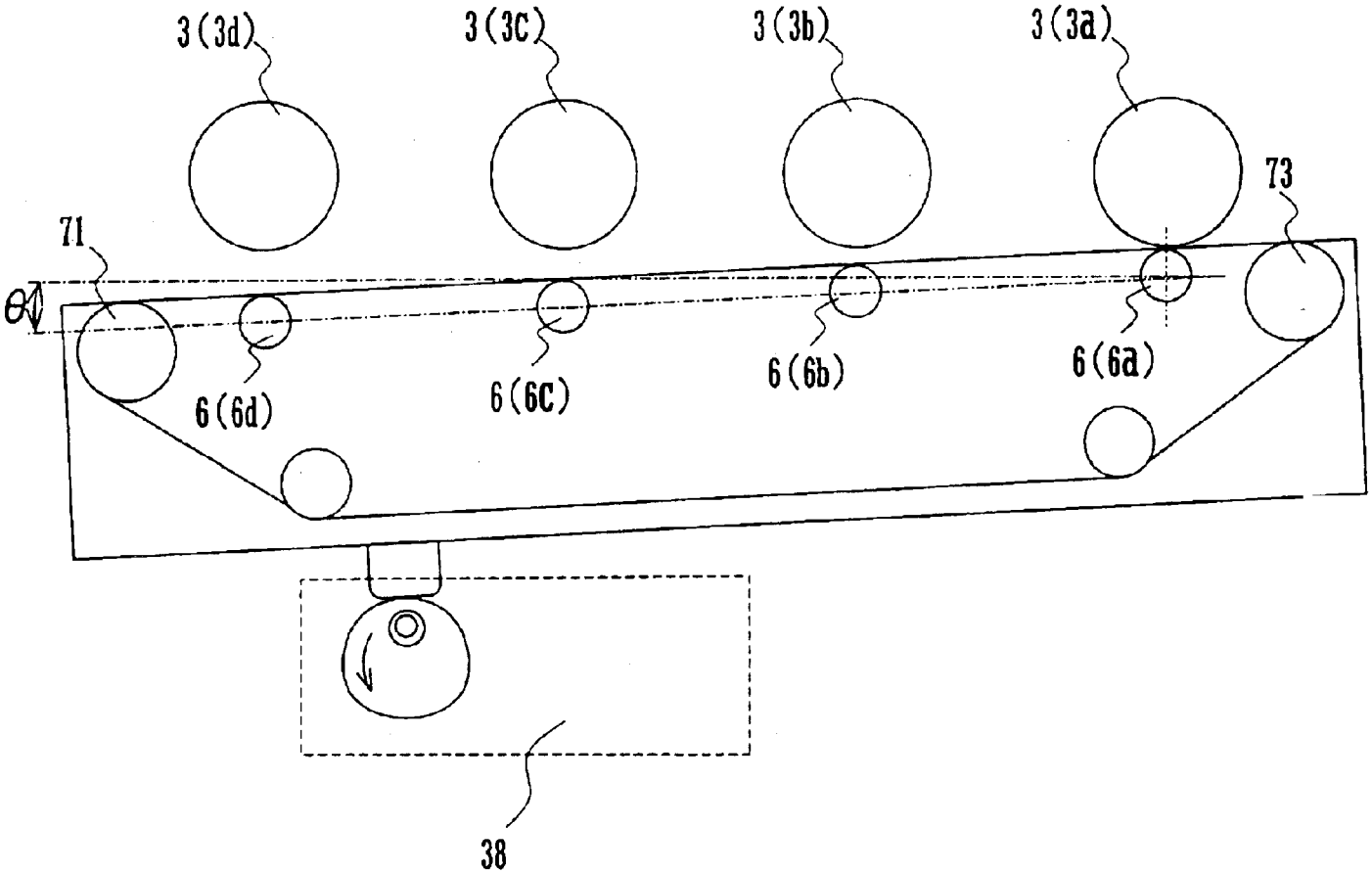
FIG. 7 is a descriptive view showing a state of a transfer carrier in a single color mode.

The restoration operation at the first stage is realized by drawing out the fixing unit 12 from the body of the image forming apparatus to thereby again move the transfer transport belt unit 8 and to move the photosensitive drum 3*a* and the transfer belt 7 perfectly from each other (by the moving-apart or -close mechanism). With the restoration operation applied, for example, a sheet wound around on the heat roller can be removed, as shown in FIG. 3. Note that the perfectly spaced apart states are shown in FIG. 5.

The jam processing is performed, for example, as control in a case where a sheet does not reach a detector (for example the sheet detector B) located in the downstream of the fixing device and it is determined that a jam occurs in the fixing unit 12. After the jam processing ends, the fixing unit 12 is inserted into the body of the image forming apparatus to thereby restore the transfer transport unit 8 to a state before the fixing unit 12 is drawn out. Note that in step S13, a current to be supplied to a heater of the fixing unit 12 is shut off for safety.

Then it is determined, in step S6, whether or not there is present another sheet passing through the sheet detector A based on information on a state of the sheet detector A being monitored when a jam occurred on the previous sheet. It is determined in Step S7 whether or not there is present a sheet sandwiched between the resist rollers 14 by the sheet detector A. In a case where there is present the sheet in step S6 or S7, the process advances to the second stage.

At the second stage, a transport distance of a sheet is set according to a printing ratio on a sheet. That is, at a higher printing ratio, a transport distance is set shorter, while at a lower printing ratio, a transport distance is set longer (s8).

Note that the printing ratio means a proportion of an area occupied by a toner image on a sheet (a proportion of an area occupied by a toner image relative to an area of a sheet). A printing ratio of a character image is usually in the range of from 5 to 15%, while a printing ratio of a photo image is roughly in the range of from 45 to 95%, though the ratio is different according to an area of a white portion (a portion to which no toner is transferred). Hence, changed-over has only to be taken place between transfer distances with a printing ratio in the range of about 20 to 30% as a boundary. This setting, however, is not limited this way since it is a value to be determined by a structure of an image forming apparatus.

A printing ratio is based on image data inputted to a write section (see FIG. 10), which is part of an image forming process section for performing an image forming process. An image kind identifying section provided in a control section 100 may also set a transport distance based on the image data. In the setting of a transport distance, a transport distance in a case where the image data is identified as line image data by the image kind identifying section can be set longer than in a case where the image data is identified as photo image data.

A construction can be adopted in which a printing ratio determining section for determining a printing ratio instead of the image kind identifying section is provided in the control section 100, and a transport distance in a case where the printing ratio determining section determines that a printing ratio of image data is lower than a predetermined ratio can be set longer than in a case where the printing ratio determining section determines that a printing ratio of image data is higher than the predetermined ratio.

Concrete examples in which a transport distance of a sheet is controlled according to a printing ratio are as follows.

Figure 4:
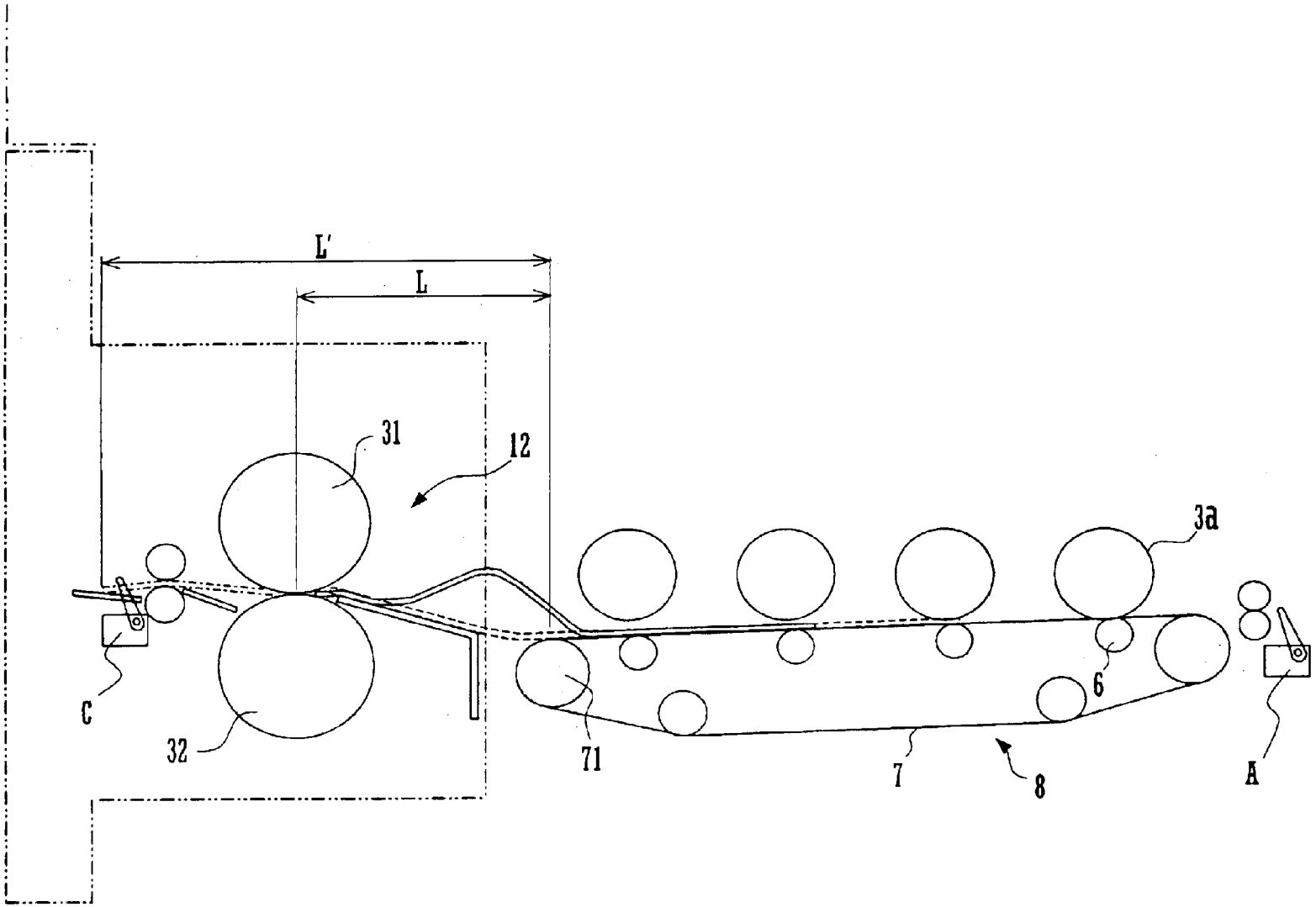
FIG. 4 is a descriptive view in a state where a sheet recording medium remains on a transfer carrier.

For example, as shown in FIG. 4, a distance L between the transfer belt driving roller 71 located at the most downstream position and the heat roller 31 is set to 100 mm, wherein a distance L' from the transfer belt driving roller 71 to the leading edge of a sheet is set to a value in the range of from 100 to 150 mm (with a bow in the range of from 0 to 50 mm) at a higher printing ratio and to a value in the range of from 150 to 200 mm (with a bow in the range of from 50 to 100 mm) at a lower printing ratio. This is because if a bow of a sheet reaches 150 mm, the interior of an image forming apparatus is easy to be made dirty. Note that a setting value may be differently set in a proper manner according to a scale or kind of the image forming apparatus.

The fixing unit 12, in step s9, starts transportation of a sheet while being kept stopped, the sheet is stopped after being transported by a transport distance set as described above (s10) and thereafter, an operator expose the fixing unit 12 to the outside open air to again conduct a jam processing (restoration operation). Note that with a long transport distance (at a low printing ratio), a sheet is bowed a little, for example as shown with a solid line in FIG. 4, before the fixing unit 12. With a short transport distance (at a high printing ratio), a sheet is stopped, for example as shown with a broken line in FIG. 4, before the fixing unit without a bow.

By setting a transport distance according to a printing ratio in this way, in a case where a printing ratio is low, even if a transport distance is increased to thereby form a large bow, and an attraction area of a sheet on a transfer carrier is reduced to thereby enable a peeling force to be diminished without making the interior of an image forming apparatus severely dirty with a toner. On the other hand, in a case where a printing ratio is high, a transport distance is reduced so as not to produce a large bow, thereby enabling the interior of an image forming apparatus to be prevented from being made severely dirty and in addition, the lower part of a sleeve to be prevented from being made dirty.

Since in the restoration operation, the transfer belt unit 8 is moved to a position where the transfer belt unit 8 is apart from all of the photosensitive drums 3, the leading edge of a remaining sheet is easy to be grasped, as shown in FIG. 5, to thereby facilitate jam processing. Since application of a transfer bias imposed on the transfer roller 6 is ceased immediately after occurrence of a jam and the transfer belt 7 is moved apart from the photosensitive drums 3*b*, 3*c* and 3*d*, an attraction force of a sheet attracted to the transfer belt 7 is reduced; therefore, the sheet is easy to be peeled off from the transfer belt 7, which also greatly contributes to facilitation of jam processing.

If the fixing unit 12 is restored to the original state after the jam processing ends, the process returns to step S7. Stagnant residence of a sheet in this step is again detected by the sheet detector A. If there is no stagnant residence of a sheet, the process advances to step S12 to operate the change-over means 38 there and to bring the transfer belt 7 into contact with all the photosensitive drums 3. Thereafter, a pre-rotation operation, which is a preliminary operation in the process section, (an operation for preparing cleaning or the like of the photosensitive drums 3 and the transfer belt 7), in step S13, is started and the pre-rotation operation, in step S14, completes, and then, a ready lamp in the operation section, in step S15, is lit up and the image forming section enters a standby state where an image can be formed.

On the other hand, in a case where it is determined, in step S6 that no sheet stays stagnant on the transfer belt 7 and no sheet, in Step S7, is detected by the sheet detector A, it is determined that the jam processing is perfectly completed. In such a case, the process advances to step S12, where the transfer belt 7 is brought into contact with all the photosensitive drums 3. Thereafter, the process advances to steps S13 and S14 and a ready lamp is lit up that indicates that image forming operation is fully prepared after the pre-rotation operation described above ends (S6 to S15). While in this embodiment, the ready lamp is lit up to thereby urge the restart of operation, an image forming operation may be restarted automatically.

In such a way, the fixing unit 12 is drawn out from the body of the image forming apparatus to firstly perform jam processing at the first stage. Thereafter, the fixing unit 12 is restored to the original position and if there is present a subsequent sheet remaining in the upstream side of the image forming apparatus, the process advances to the second stage. At the second stage, the sheet is transported to a site in the downstream side where the sheet is easily taken out under an attraction force suitably adapted to an environmental condition. The jam processing is conducted for the second time and a restoration operation can be performed with certainty without leaving any sheet behind. The site where a sheet is easily taken out has only to be in the vicinity of the entrance to the fixing unit 12. For example, at least part of the sheet has only to be located in a position in a space bridging the area of the fixing unit 12 and the area of the transfer belt 7.

Note that in a case where it is determined that a jam occurs, driving of some of the sheet transport means in the upstream side including the resist rollers 14 is ceased. In a case where there is present a sheet that is clenched between the resist rollers 14 and thereby enters the region of the transfer belt 7, the sheet is transported by the transfer belt 7 till or a site before the leading edge thereof is clenched between the roller members 31 and 32 of the fixing unit 12 by the transfer belt 7. In this situation, a resist roller 14 is rotation-driven by a roller 14 in the driving side with the help of unidirectional crutches not shown provided between the roller 14 in the driven side and a driving system. Rollers pinching a sheet in the upstream side including the resist rollers 14 may be driven.

Description will be given of another embodiment.

In this embodiment, in a case where a jam is detected, a rotation operation of the transfer belt 7 in the upstream side of the fixing unit 12 is not stopped immediately.

FIG. 12 shows a flowchart of this embodiment.

A construction of this embodiment is the same as that of the embodiment described above except portions different from the contents of control shown in FIG. 11.

That is, as shown in FIG. 12, in a case where a jam occurs after the start of an image forming operation (S21 to S22), the following operations are ceased: an image forming operation (a write operation to a photosensitive drum 3 with an exposure unit 1, a developing operation by a developer 2 and the like), and an operation of the fixing unit (a heating operation with a heater and rotation operations of the rollers 31 and 32) (S23).

Then, a transport distance is set according to a printing ratio on a sheet (s24). Therefore, in this embodiment, a transport distance, at the first stage, is set according to printing ratio on a sheet.

Note that termination of an image forming operation in step S23 is to cease exposure operations by the exposure units 1 and developing operations of the developers 2. Termination of a developing operation of the developer 2 is implemented by control of application of a transfer bias or control of a distance (moving-apart or -close) between the developer 2 and a photosensitive drum 3.

Furthermore, the change-over means 38 is operated to move the transfer transport unit 8 by pivoting it and to move the transfer belt 7 apart from the photosensitive drums 3*b* to 3*d* (S25). This is because as described above, an attraction force of a sheet to the transfer belt 7 is reduced to the lowest possible level to thereby facilitate the sheet to be peeled off from the transfer belt 7 and also because images already formed on the photosensitive drums 3*b* to 3*d* are prevented from being transferred to a sheet.

Simultaneously, application of a transfer bias to the transfer rollers 6*b* to 6*d* is also ceased (S26). This is to reduce an attraction force of a sheet to the transfer belt 7. In a case where an attraction force of the sheet to the transfer belt 7, in this step, is hard to decrease, the attraction force may be positively reduced by changing over from a high voltage application to the transfer rollers 6*b* to 6*d* described above to an AC high voltage output.

Then, the sheet firmly attracted on the transfer belt 7 is continually transported in a state of being not in contact with the photosensitive drums 3*b* to 3*d*, and transportation of the sheet is ceased after transportation of the sheet is continued by the transfer belt 7 for a time till the leading edge of the sheet sufficiently intrudes into the area of the fixing unit 12 (S28 and S29). This is because in a case where two sheet is transported on the transfer belt 7, the leading sheet and the subsequent sheet are gathered before the roller members 31 and 32 of the fixing unit 12 to thereby conduct a jam processing for both simultaneously (at one time).

This is because images formed already on the photosensitive drums 3*b*, 3*c* and 3*d* are prevented from being transferred onto a sheet.

Application of a transfer bias to the transfer roller 6 is simultaneously stopped (s26). This is because an attraction force on a sheet to the transfer belt 7 is reduced and because an image formed already on the photosensitive drum 3*a* is not transferred to a sheet. In this step, an AC high voltage output may also be positively applied instead of the application of a high voltage to the transfer rollers 6*b*, 6*c* and 6*d* to reduce the attraction force.

Then, the sheet attracted on the transfer belt is transported while being kept in no contact with the photosensitive drums 3*b*, 3*c* and 3*d* by a predetermined distance and thereafter, stopped there (s28 to s29). This is because in a state where two sheets are transported on the transfer belt 7, the leading sheet and subsequent sheet thereof are gathered before the roller members 31 and 32 of the fixing unit 12 to subject the two sheets to a simultaneous jam processing (at a time).

In this case, if the subsequent sheet is held being sandwiched in the resist roller 14, which are a transport means located downstream, the roller members thereof are driven to transport the sheet smoothly.

Figure 8A:
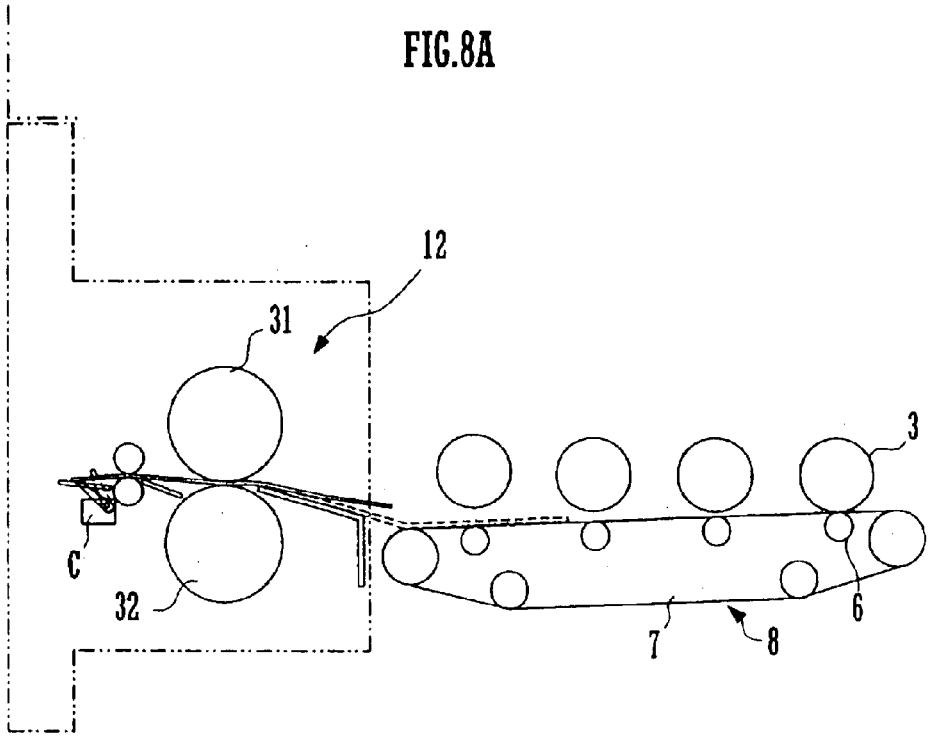
FIGS. 8A and 8B are descriptive views in a case where two recording media remain on a transfer carrier and a jam processing is performed.
Figure 8B:
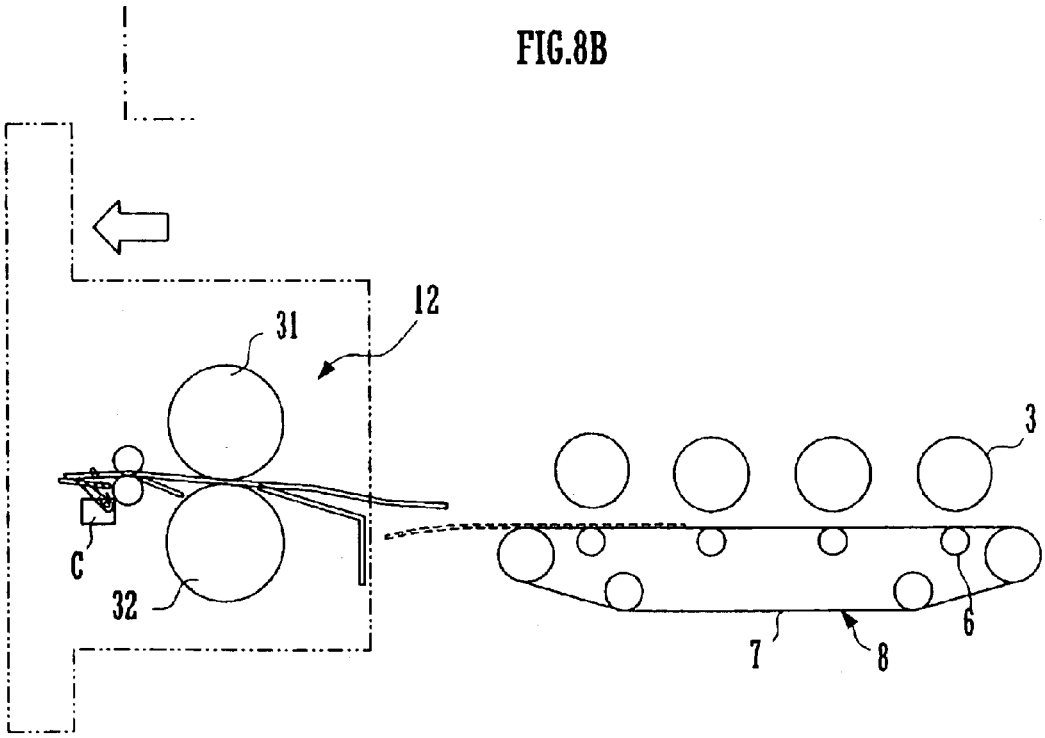

In this embodiment, the process, after occurrence of a jam, advances into the first stage to cease an image forming operation and a rotation operation of the fixing unit 12, and the sheet, at the same first stage, is transported only by a transport distance according to a printing ratio to reach a state as shown in FIG. 8(A), where transportation of the sheet is completely ceased. A restoration operation, in step s30, is implemented. That is, at first, the fixing unit 12 is, as shown in FIG. 8(B), drawn out from the body of the image forming apparatus by an operator to thereby, further move the transfer transport unit 8 with the moving-apart and -close mechanism moving together with the draw-out operation so that the transport belt 7 is apart from all the photosensitive drums 3. Then, the operator implements a restoration operation (a jam processing) for taking out two sheets as described above.

After jam processing is completed, the fixing unit 12 is inserted into the body of the image forming apparatus to restore the original state (a state where only the photosensitive drum 3*a* is in contact with the transfer belt 7) of the transfer transport unit 8.

Then, it is confirmed in step s31 by the sheet detector A whether or not a sheet stays stagnant in the resist roller 14 and if residence of the sheet in the roller 14 is recognized, the process advances to the second stage. The sheet, at this second stage, is transported till the leading edge of the sheet staying stagnant, similarly to that described in s36 and s37, intrudes, or to be more exact, sufficiently intrudes, into an area of the fixing unit 12 and a restoration operation, in step s38, is again performed the operator.

After the restoration operation, the process again returns to step s31 to confirm whether or not a sheet stays stagnant. In a case where it is not recognized in step s31 that a sheet stays stagnant, it is determined that a restoration operation (jam processing) is completed and the process advances to step s32 to cause the transfer belt 7 to be brought into contact with all of the photosensitive drums 3.

Thereafter, in step s33, the rotation operation (a preparation operation for cleaning or the like of the photosensitive drums 3 and the transfer belt 7), which is a preliminary operation of the process section, is started and in step s34 ends, and thereafter, a ready lamp of an operation section, in step s35, is lit up to thereby cause the process to advance into a standby state where an image can be formed.

The flow of a process from step s31 to steps s36 and to s38, and then a returning to step s31 is a series of operations performed for making double sure and the same operations as a series of operations from steps s8 to s10 and then returning to step s7; therefore description thereof is omitted.

The present invention is not limited to the embodiments described above and modification, improvement and the like in design thereon are freely made properly according to a need as far as not departing from the spirit and scope of the present invention. An image forming apparatus of the present invention is not limited to the construction shown in FIGS. 1 and 2 and may be an image forming apparatus of any construction and form in which not only are toner images formed on image carriers are transferred onto a sheet recording medium transported while being attracted onto a transfer carrier to fix the toner image onto the sheet recording medium in a fixing device, but an anomaly in transportation of the sheet recording medium is also judged by a jam processing control means to cease transportation thereof (or an image forming operation) when the anomaly in transportation occurs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

plural image carriers that carry toner images formed by an image forming process in operation thereof and are disposed along a sheet transport direction;

a transfer carrier for transporting a sheet recording medium attracting it in the sheet transport direction to transfer said toner images carried on said plural image carriers onto said sheet recording medium;

a transfer voltage applying section for applying a transfer voltage to said sheet recording medium carried on said transfer carrier;

a fixing device for fixing a toner image on said sheet recording medium transported by said transfer carrier and is installed so as to be capable of moving toward outside of a side surface of the body of said image forming apparatus; and a jam processing control section for detecting occurrence of a jam on said sheet recording medium during said image forming process to process said sheet recording medium in said jam, wherein said jam processing control section, when detecting occurrence of said jam, ceases transportation of said sheet recording medium in said jam by said transfer carrier as a first stage to make it possible to remove said sheet recording medium in said jam, and, if a second sheet recording medium in transit when said jam occurs is detected by said transfer carrier, advances to a second stage and restarts transportation of said second sheet recording medium in transit using said transfer carrier so that a transport distance thereof corresponds to a printing ratio of said image formed on said second sheet recording medium.

2. The image forming apparatus according to claim 1, wherein said jam processing control section controls such that said transport distance of said second sheet recording medium at said second stage is longer at a lower printing ratio than at higher printing ratio.

3. The image forming apparatus according to claim 1, wherein said jam processing control section at said second stage transports said sheet recording medium as far as just before a position where the leading edge of said sheet is clenched between roller members of said fixing device.

4. The image forming apparatus according to claim 1, further comprising a moving-apart or -close section for moving said transfer carrier apart from second image carriers except a first image carrier located in the most upstream side in a sheet transport direction among said plural image carriers, wherein said moving-apart or -close section, at said second stage, moves said transfer carrier apart from said second image carriers.

5. The image forming apparatus according to claim 4, wherein said first image carrier, at the second stage, continues rotation driving thereof and said second image carriers cease rotation driving thereof at the same second stage.

6. The image forming apparatus according to claim 4, wherein said first image carrier carries a toner image in a single color and said second image carriers carry toner images in respective other colors.

7. The image forming apparatus according to claim 1, further comprising an image kind identifying section for identifying whether image data inputted to an image forming process section for performing said image forming process is line image data such as characters or photo image data such as a photograph, wherein said jam processing control section sets such that said transport distance in a case where said image data is identified as line image data by said image kind identifying section is longer than in a case where said image data is identified as photo image data by said image kind identifying section.

8. The image forming apparatus according to claim 1, further comprising a printing ratio determining section for determining said printing ratio based on image data inputted to an image forming process section for performing said image forming process, wherein said jam processing control section sets such that said transport distance in a case where the printing ratio determining section determines that a printing ratio of said image data is lower than a predetermined ratio is longer than in a case where the printing ratio determining section determines that a printing ratio of said image data is higher than the predetermined ratio.

9. An image forming apparatus comprising:

plural image carriers that carry toner images, thereon, formed by an image forming process in operation thereof and are disposed along a sheet transport direction;

a transfer carrier for transporting a sheet recording medium attracting it in the sheet transport direction to transfer said toner images carried on said plural image carriers onto said sheet recording medium;

a transfer voltage applying section for applying a transfer voltage to said sheet recording medium carried on said transfer carrier;

a fixing device for fixing a toner image on said sheet recording medium transported by said transfer carrier and is installed so as to be capable of moving toward outside of a side surface of the body of said image forming apparatus; and a jam processing control section for detecting occurrence of a jam on said sheet recording medium during said image forming process to process said sheet recording medium in said jam, wherein said jam processing control section, when detecting occurrence of said jam, ceases transportation of said sheet recording medium in said jam by said transfer carrier after said recording medium is transported by said transfer carrier by a distance corresponding to a printing ratio of said image formed on said sheet recording medium as a first stage to thereby make it possible to remove said sheet recording medium in said jam, and, if a second sheet recording medium in transit when said jam occurs is detected by said transfer carrier, advances to a second stage to transport said second sheet recording medium in transit using said transfer carrier for a predetermined time and to thereafter stop it.

10. The image forming apparatus according to claim 9, wherein said jam processing control section controls such that a transport distance of said recording medium at said first stage is longer in a case where said printing ratio is higher than in a case where said printing ratio is lower.

11. The image forming apparatus according to claim 9, wherein said jam processing control section at said first stage transports said sheet recording medium as far as just before a position where the leading edge of said sheet is clenched between roller members of said fixing device.

12. The image forming apparatus according to claim 9, further comprising a moving-apart or -close section for moving said transfer carrier apart from second image carriers except a first image carrier located in the most upstream side in a sheet transport direction among said plural image carriers, wherein said moving-apart or -close section, at said first stage, moves said transfer carrier apart from said second image carriers.

13. The image forming apparatus according to claim 9, wherein said first image carrier, at the first stage, continues rotation driving thereof and said second image carriers cease rotation driving thereof at the same first stage.

14. The image forming apparatus according to claim 9, wherein said first image carrier carries a toner image in a single color and said second image carriers carry toner images in respective other colors.

15. The image forming apparatus according to claim 9, further comprising an image kind identifying section for identifying whether image data inputted to an image forming process section for performing said image forming process is line image data such as characters or photo image data such as a photograph, wherein said jam processing control section sets such that said transport distance in a case where said image data is identified as line image data by said image kind identifying section is longer than in a case where said image data is identified as photo image data by said image kind identifying section.

16. The image forming apparatus according to claim 9, further comprising a printing ratio determining section for determining said printing ratio based on image data inputted to an image forming process section for performing said image forming process, wherein said jam processing control section sets such that said transport distance in a case where the printing ratio determining section determines that a printing ratio of said image data is lower than a predetermined ratio is longer than in a case where the printing ratio determining section determines that a printing ratio of said image data is higher than the predetermined ratio.

* * * * *